US010909928B2

(12) United States Patent
Okamoto

(10) Patent No.: US 10,909,928 B2
(45) Date of Patent: Feb. 2, 2021

(54) IMAGE DISPLAY APPARATUS AND CONTROL METHOD THEREOF

(71) Applicant: Huawei Technologies Co., Ltd., Shenzhen (CN)

(72) Inventor: Tadayuki Okamoto, Kanagawa (JP)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 16/626,077

(22) PCT Filed: Jun. 23, 2017

(86) PCT No.: PCT/CN2017/089775
§ 371 (c)(1),
(2) Date: Dec. 23, 2019

(87) PCT Pub. No.: WO2018/232737
PCT Pub. Date: Dec. 27, 2018

(65) Prior Publication Data
US 2020/0219448 A1 Jul. 9, 2020

(51) Int. Cl.
*G09G 3/3258* (2016.01)
*G09G 3/3275* (2016.01)

(52) U.S. Cl.
CPC ..... *G09G 3/3258* (2013.01); *G09G 3/3275* (2013.01); *G09G 2310/0291* (2013.01);
(Continued)

(58) Field of Classification Search
CPC ... G09G 2300/0819; G09G 2310/0259; G09G 2310/0291; G09G 2310/066;
(Continued)

(56) References Cited

U.S. PATENT DOCUMENTS 5,489,918 A 2/1996 Mosier
7,079,091 B2 7/2006 Kondakov et al.
(Continued)

FOREIGN PATENT DOCUMENTS

CN 102110411 A 6/2011
CN 106847175 A 6/2017
(Continued)

OTHER PUBLICATIONS

Buso, D., et al., "OLED Electrical Equivalent Device for Driver Topology Design," IEEE Transactions on Industry Applications, vol. 50, No. 2, Mar./Apr. 2014, pp. 1459-1468.

*Primary Examiner* — Dmitriy Bolotin
(74) *Attorney, Agent, or Firm* — Conley Rose, P.C.

(57) ABSTRACT

An image display apparatus including multiple pixel elements which are configured to display an image, a first power source which is configured to apply a voltage to the multiple pixel elements, a counter which is configured to output counter signals, a ramp generator which is configured to receive the counter signals and output ramp signals according to the counter signals, a second power source which is configured to apply a voltage to the multiple pixel elements according to the ramp signals, an amplifier which is configured to output a trigger signal in case that a first pixel element in the multiple pixel elements outputs an electric current, a data driver which is configured to output a counter value according to the counter signal and the trigger signal, and a buffer which is configured to store the counter value.

20 Claims, 14 Drawing Sheets

(52) U.S. Cl.
CPC ..... *G09G 2310/066* (2013.01); *G09G 2320/0233* (2013.01); *G09G 2330/021* (2013.01); *G09G 2330/028* (2013.01)

(58) Field of Classification Search
CPC ... G09G 2320/0233; G09G 2320/0295; G09G 2320/043; G09G 2320/045; G09G 2330/021; G09G 2330/028; G09G 2330/12; G09G 3/3225; G09G 3/3233; G09G 3/3258; G09G 3/3275
See application file for complete search history.

(56) References Cited

U.S. PATENT DOCUMENTS

| | | | | |
|---|---|---|---|---|
| 8,026,876 | B2 | 9/2011 | Nathan et al. | |
| 10,176,736 | B2 * | 1/2019 | Chaji | G09G 3/3258 |
| 10,283,043 | B2 * | 5/2019 | Lee | G09G 3/3233 |
| 10,720,100 | B2 * | 7/2020 | Lee | G09G 3/3291 |
| 2005/0024353 | A1 * | 2/2005 | Amundson | G09G 3/344 345/204 |
| 2005/0067968 | A1 * | 3/2005 | Yamashita | G09G 3/3266 315/167 |
| 2006/0170623 | A1 * | 8/2006 | Naugler | G09G 3/2081 345/76 |
| 2009/0179923 | A1 * | 7/2009 | Amundson | G09G 3/344 345/690 |
| 2009/0184901 | A1 | 7/2009 | Kwon | |
| 2011/0157133 | A1 | 6/2011 | Ogura | |
| 2013/0250152 | A1 | 9/2013 | Saito | |
| 2014/0009650 | A1 | 1/2014 | Kim et al. | |
| 2014/0055635 | A1 | 2/2014 | Seo | |
| 2014/0146210 | A1 | 5/2014 | Lee et al. | |
| 2014/0204298 | A1 * | 7/2014 | Ashbrook | G01R 31/2607 349/41 |
| 2014/0204330 | A1 * | 7/2014 | Ashbrook | G09G 3/3688 349/196 |
| 2015/0154899 | A1 | 6/2015 | Chang et al. | |
| 2016/0351130 | A1 | 12/2016 | Kikuchi et al. | |
| 2019/0385568 | A1 | 12/2019 | Song et al. | |
| 2020/0219448 | A1 * | 7/2020 | Okamoto | G09G 3/3275 |

FOREIGN PATENT DOCUMENTS

| | | | |
|---|---|---|---|
| CN | 106847176 | A | 6/2017 |
| EP | 1826744 | A2 | 8/2007 |

* cited by examiner

IMAGE DISPLAY APPARATUS AND CONTROL METHOD THEREOF

CROSS-REFERENCE TO RELATED APPLICATIONS

This application is a National Stage of International Application No. PCT/CN2017/089775 filed on Jun. 23, 2017, which is hereby incorporated by reference in its entirety.

TECHNICAL FIELD

The present application may relate to, for example, an image display apparatus and a control method of the image display apparatus.

BACKGROUND

In general, a high quality display apparatus is desired.

In the prior art, there are several methods for evaluating degradation of pixels of a display apparatus focusing on an I-V (current-voltage) characteristics or a capacitance. For example, as shown below.

(1) U.S. Patent Application Publication No. 20090184901 A1 (Organic light emitting display and driving method thereof)

(2) U.S. Pat. No. 8,026,876 B2 (OLED luminance degradation compensation)

(3) U.S. Pat. No. 7,079,091 B2 (Compensating for aging in OLED devices)

However, it may be understood that these prior documents disclose proposals for directly measure DC (direct current) components, and thus, in consideration of noise, they may not have practicability.

SUMMARY

The explanations below are mere examples and do not limit and/or restrict the present application.

A first aspect is an image display apparatus including: multiple pixel elements which are configured to display an image; a first power source which is configured to apply a voltage to the multiple pixel elements; a counter which is configured to output counter signals; a ramp generator which is configured to receive the counter signals and output ramp signals according to the counter signals; a second power source which is configured to apply a voltage to the multiple pixel elements according to the ramp signals; an amplifier which is configured to output a trigger signal in case that a first pixel element in the multiple pixel elements outputs an electric current; a data driver which is configured to output a counter value according to the counter signal and the trigger signal; and a buffer which is configured to store the counter value.

A second aspect is the image display apparatus according to the first aspect, wherein the second power source is further configure to sweeps the voltage applied to the multiple pixel elements according to the ramp signals.

A third aspect is the image display apparatus according to the first aspect, wherein the multiple pixel elements are arranged on a matrix which includes a predetermined number of rows and a predetermined number of columns, wherein the data driver is configure to output the counter value with a column number on which the first pixel element is arranged, and wherein the buffer is configure to store the counter value with the column number.

A fourth aspect is the image display apparatus according to the third aspect, wherein the amplifier is arranged to correspond to each column of the multiple pixel elements.

A fifth aspect is the image display apparatus according to the first aspect, wherein the multiple pixel elements are arranged on a matrix which includes a predetermined number of rows and a predetermined number of columns, and wherein the amplifier is arranged to correspond to each row of the multiple pixel elements.

A sixth aspect is the image display apparatus according to the fourth aspect, further including: a control device is configured to select a row of the matrix, wherein the first power source and the second power source apply voltage to pixel elements on the selected row.

A seventh aspect is the image display apparatus according to the first aspect, wherein the amplifier includes an emitter and a base, the emitter is configured to receive an electric current from the first power source and the base is configured to output the electric current, and wherein the first pixel element receives the electric current output from the base.

An eighth aspect is the image display apparatus according to the sixth aspect, wherein the control device repeatedly selects the rows of the matrix in a serial manner, and wherein the data driver stores the counter value and column number of pixel elements of each row in the buffer.

A ninth aspect is the image display apparatus according to the first aspect, wherein the apparatus further includes a processor, the processor is configured to detect errors of the multiple pixel elements according to the counter value.

A tenth aspect is the image display apparatus according to the first aspect, wherein the apparatus further includes a processor, the processor is configured to detect an error of one of the multiple pixel elements in case that the trigger signal is not output within a predetermined time interval.

An eleventh aspect is a controlling method of an image display apparatus including: applying, by a first power source, a voltage to multiple pixel elements; applying, by a second power source, a voltage according to ramp signals generated in reference to counter signals to the multiple pixel elements; outputting, by an amplifier, a trigger signal in case that a first pixel element included in the multiple pixel elements outputs an electric current; outputting, by a data driver, a counter value according to the counter signal and the trigger signal; and when receiving the counter value from the data driver, storing, by a buffer, the counter value.

A twelfth aspect is the controlling method of the image display apparatus according to the eleventh aspect, wherein the second power source sweeps the voltage applied to the multiple pixel elements according to the ramp signals.

A thirteenth aspect is the controlling method of the image display apparatus according to the eleventh aspect, wherein the multiple pixel elements are arranged on a matrix including a predetermined number of rows and a predetermined number of columns, wherein the data driver outputs the counter value with a column number on which the first pixel element is arranged, and wherein the buffer stores the counter value with the column number.

A fourteenth aspect is the controlling method of the image display apparatus according to the thirteenth aspect, wherein the amplifier is arranged to correspond to each column of the multiple pixel elements.

A fifteenth aspect is the controlling method of the image display apparatus according to the eleventh aspect, wherein the multiple pixel elements are arranged on a matrix including a predetermined number of rows and a predetermined number of columns, and wherein the amplifier is arranged to correspond to each row of the multiple pixel elements.

A sixteenth aspect is the controlling method of the image display apparatus according to the fourteenth aspect, further including selecting, by a control device, a row of the matrix, wherein the first power source and the second power source apply voltage to pixel elements on the selected row.

A seventeenth aspect is the controlling method of the image display apparatus according to the eleventh aspect, wherein the amplifier includes an emitter receiving an electric current from the first power source and a base outputting the electric current, and wherein the first pixel element receives the electric current output from the base.

An eighteenth aspect is the controlling method of the image display apparatus according to the sixteenth aspect, wherein the control device repeatedly selects the rows of the matrix in a serial manner, and wherein the data driver stores the counter value and column number of pixel elements of each row in the buffer.

A nineteenth aspect is the controlling method of the image display apparatus according to the eleventh aspect, further including detecting, by a processor, errors of the multiple pixel elements according to the counter value stored in the buffer.

A twentieth aspect is the controlling method of the image display apparatus according to the eleventh aspect, further including detecting, by a processor, an error of one of the multiple pixel elements in case that the trigger signal is not output within a predetermined time interval.

A twenty-first aspect is an image display apparatus including: multiple pixel elements which are configured to display an image; a first power source means for applying a voltage to the multiple pixel elements; a counter means for outputting counter signals; a ramp generator means for receiving the counter signals and outputting ramp signals according to the counter signals; a second power source means for applying a voltage to the multiple pixel elements according to the ramp signals; an amplifying means for outputting a trigger signal in case that a first pixel element included in the multiple pixel elements outputs an electric current; a data driver means for outputting a counter value according to the counter signal and the trigger signal; and a buffer means for receiving and storing the counter value.

DESCRIPTION OF EMBODIMENTS

It can be an important issue for a display device to maintain luminance equality of each pixel. Pixels of a small display installed in, for example, a mobile device may have the same issue. It can be an important issue for a display apparatus to compensate inequality of luminance. For example, this is an important issue for an OLED (organic light emission diode) display device and a high-definition display used for a mobile device.

Figure 1:
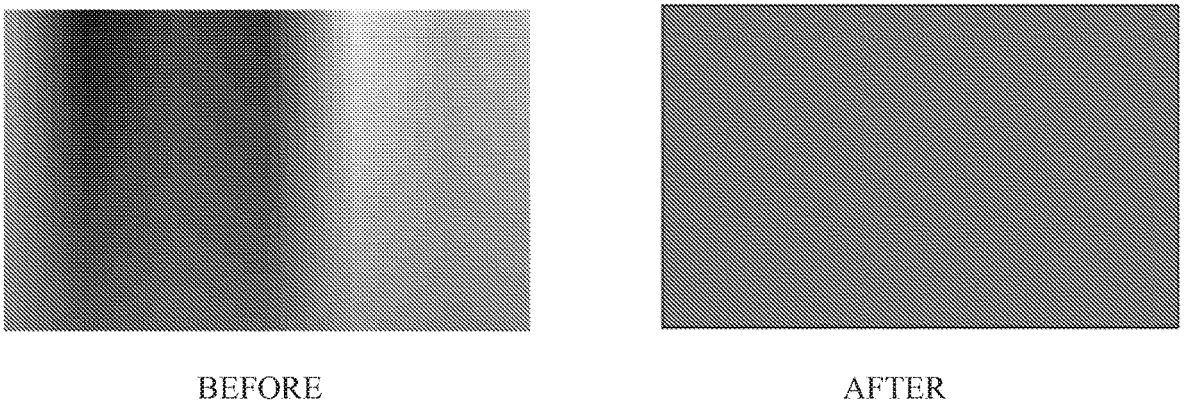
FIG. 1 is a drawing showing a display screen before and after compensation of luminance.

In general, it is possible to compensate initial problems and/or errors of pixels/pixel elements by using camera data. FIG. 1 shows an example of inequality of luminance of an image. An example before compensation is shown at the left side, and an example after compensation is shown at the right side. In FIG. 1, inequality of luminance is compensated.

Figure 2:
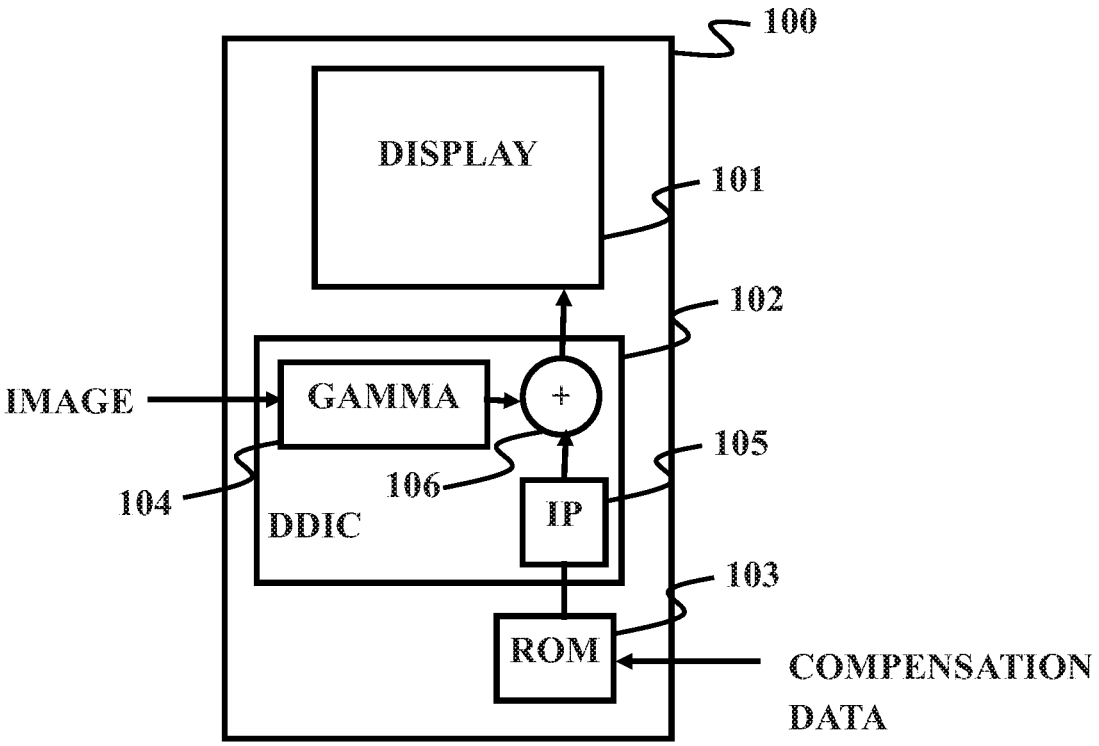
FIG. 2 is an overview of a display apparatus.

FIG. 2 shows outline of an example of a compensation operation on a cellular phone system. In FIG. 2, "100" is a cellular phone system. "101" is a display device. "102" is a processor which conducts, for example, calculation operation in a compensation operation. "103" is a ROM (read only memory) storing compensation data. "105" is an IP circuit (IP (intellectual property) core) including a group of various circuits integrated in one package. "106" is an adding circuit or adder which conducts an adding/integrating operation of various compensation values.

The compensation data can be provided from outside when delivering from a factory and be stored in the ROM 103. The adder 106 can receive the compensation data from a gamma compensation circuit 104 and the IP circuit 105, add/integrate compensation values of each of the pixels on a screen to apply them to the image data, and output the image data to the display device 101. The display device 101 inputs/receives the compensated image data from the adder 106 and displays the image data on the screen.

The compensation data can be generated by an external computer, for example, a personal computer, based on a captured screen captured by an external component, for example, a CCD (charge coupled device) camera which takes an image of the screen of the display device 101. The external computer detects, for example, unevenness of luminance based on the captured image and generates data indicating compensation of, for example, increasing an electric current applied to pixels of a portion with low luminance and decreasing the electric current applied to pixels of a portion with high luminance.

Figure 3:
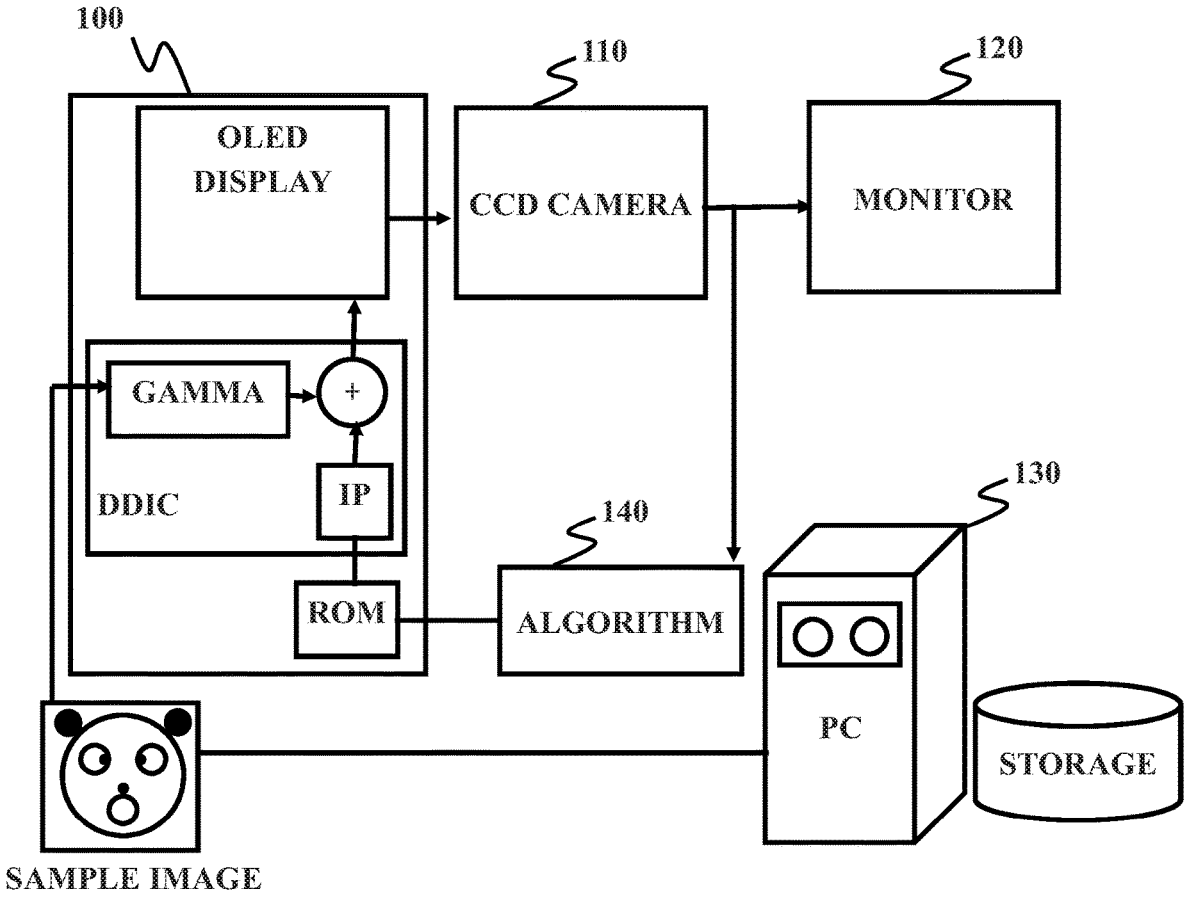
FIG. 3 is an overview of a system for compensating a display apparatus.

FIG. 3 shows an electric current measuring method/system for an initial compensation with a CCD camera. "100" is a cellular phone system of FIG. 2. "110" is a CCD camera. "120" is a monitor attached to a PC (personal computer) 130. "140" is a computer program which is installed and executed in the PC 130 and includes an algorithm for generating the compensation data.

Initial errors of pixels can be compensated based on the camera data output from the CCD camera 110. This compensation can include operations of, for example, calculating the average value of luminance of all pixels, increasing an electric current of pixel elements included in an area having lower luminance than the average value in a manner in which the electric current is increased so as to be proportional to a difference of luminance compared to the average value, and decreasing an electric current of pixel elements included in an area having higher luminance than the average value in a manner in which the electric current is decreased so as to be proportional to a difference of luminance compared to the average value.

The CCD camera 110 is installed in a production line of the cellular phone system 100. It may be possible for this system/method to conduct an accurate compensation. This system/method may be used during a manufacturing process of the cellular phone system 100 because multiple external equipments are used.

Figure 4:
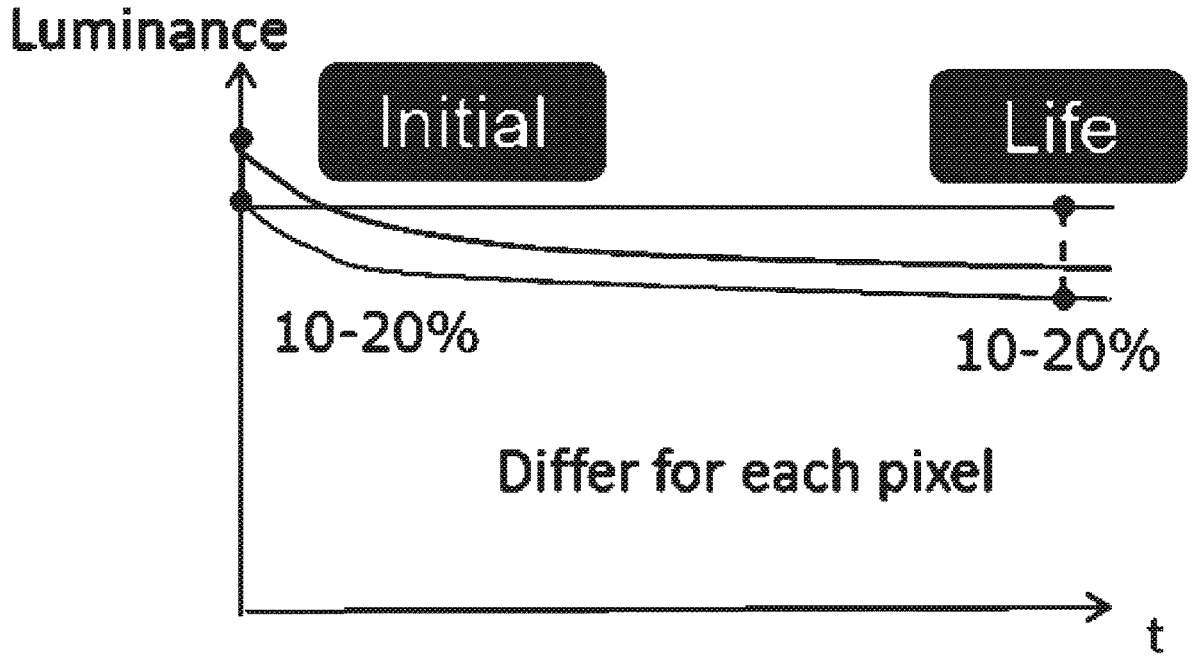
FIG. 4 is a drawing showing a relationship between luminance and time.

It may be possible to compensate initial pixel luminance errors by the system/method using external equipments. However, there is a possibility that the cellular phone system 100 may have other pixel errors after the manufacturing process. FIG. 4 is a graph showing pixel errors due to, for example, aging degradation.

A vertical axis of FIG. 4 corresponds to luminance (candela). A horizontal axis indicates time. The luminance of pixels is deteriorated according to increased total time of usage of the display device, for example, 1,000 hours, 2,000 hours. The graph of FIG. 4 includes a pair of curves. The luminance of pixels on the same display device can have unevenness and/or disperse. The pair of curves on the graph of FIG. 4 indicates to the pixel with high luminance and the pixel with low luminance. As shown in the graph of FIG. 4, when the total time of use increases, the luminance of the pixels may have deterioration of approximately 10 to 20%. In addition, when the total time of use increases, luminance of the pixel currently having a comparatively high luminance can be lower than an initial luminance of the pixel currently having comparatively low luminance.

The pixel errors caused by aging degradation shown in FIG. 4 can be compensated by the same method as shown in FIG. 3. However, the method of FIG. 3 uses the external equipments, for example, a CCD camera, and due to this, it may not be easy to apply the method in a stand-alone manner.

If there is another method and/or system than FIG. 4, such a method/system may be generally preferable which can measure the aging degradation and does not require external equipments.

In general, a mobile device having a display with high resolution may have small pixels. In addition, in many cases, mobile devices are used in unstable environments, and due to this, signals from OLED pixels are generally sensitive to a noise. Signal values have meanings, and it is necessary to understand the meaning for a measurement operation of pixel errors, a long measurement time and a sophisticated sensor may be necessary to measure a DC (direct current) component with sufficient accuracy.

Figure 5:
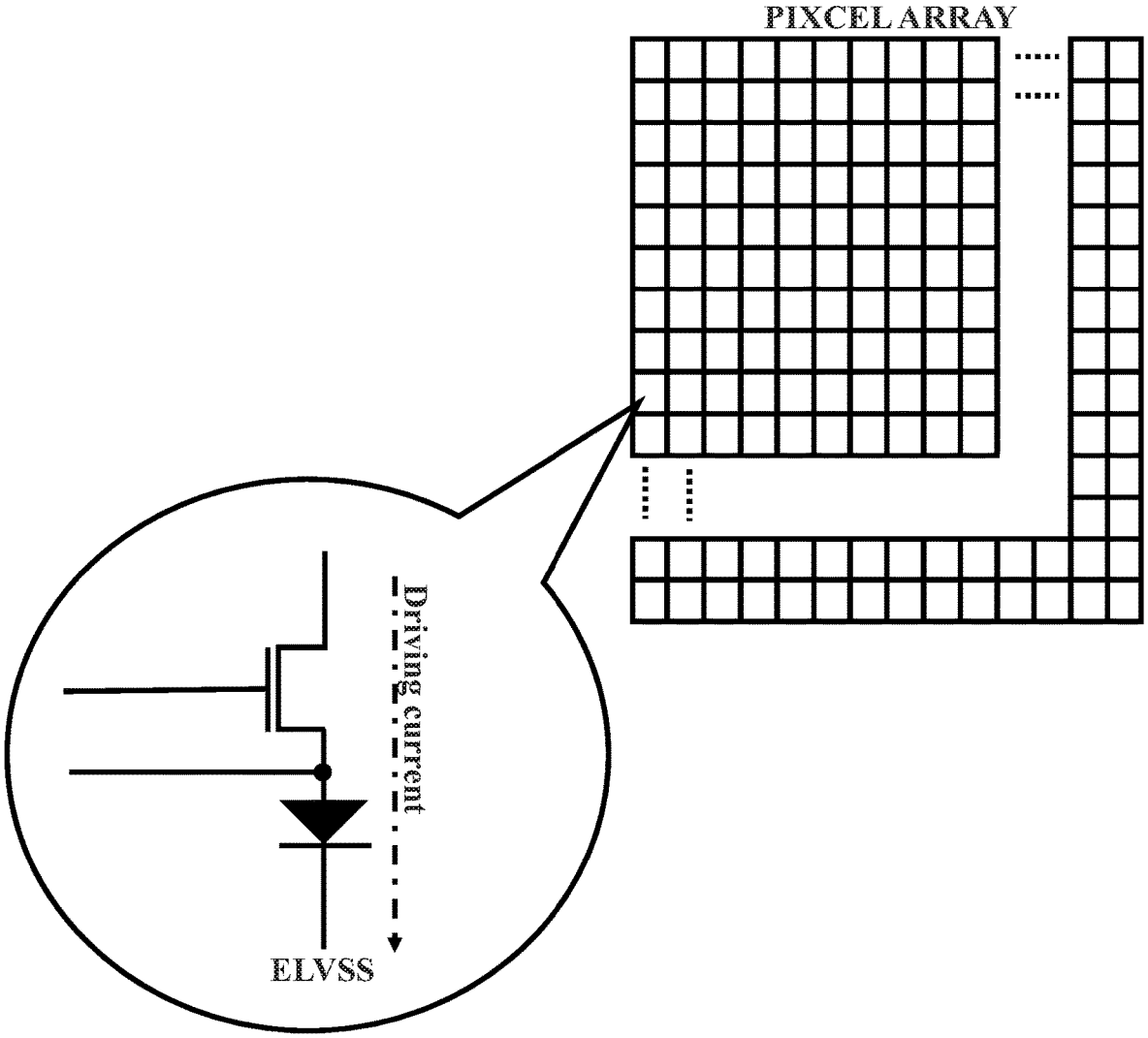
FIG. 5 is an overview of pixel arrays.

FIG. 5 shows a driving current of an OLED pixel. In FIG. 5, each of multiple pixel elements is constituted from a circuit including, for example, a diode and a transistor. An electric current is applied to this circuit to cause the OLED to irradiate. An ELVSS (low level power source) can be connected to a cathode of the OLED.

The driving current shown in FIG. 5 is, for example, approximately from a few nA to 100 nA, and this may be further small for a display with high resolution. Therefore, in order to measure values of the driving current of OLED pixels, for example, it may be necessary to arrange highly sophisticated amplifiers having a high gain, high impedance and an offset adjustment function while driving the OLED, to all columns (1080×3 for FHD (full high definition) and RGB (red, green and blue)). In addition, it may be possible to conduct such a measurement operation in a basically stable environment, for example, a laboratory. However, this is different from the environment in which a cellular phone is practically used. Furthermore, it may take several minutes to obtain reliable measured values with regard to all pixels.

In general, it is preferable if it is possible to forecast a degree of degradation of OLED pixels. Further, in general, it may be preferable if it is possible to accurately, quickly and cost-effectively obtain, for example, values for this forecasting operation.

Hereafter, a first embodiment is explained.

In this embodiment, digital values are directly generated based on signals from OLED pixels. In this embodiment, for example, digital values which are tolerant to the noise are generated. In addition, in this embodiment, it can be possible to reduce the measurement time because operations on all pixels of each of the rows are simultaneously conducted.

As described above, I-V characteristics may indicate degradation of luminance of OLED pixels.

Figure 6:
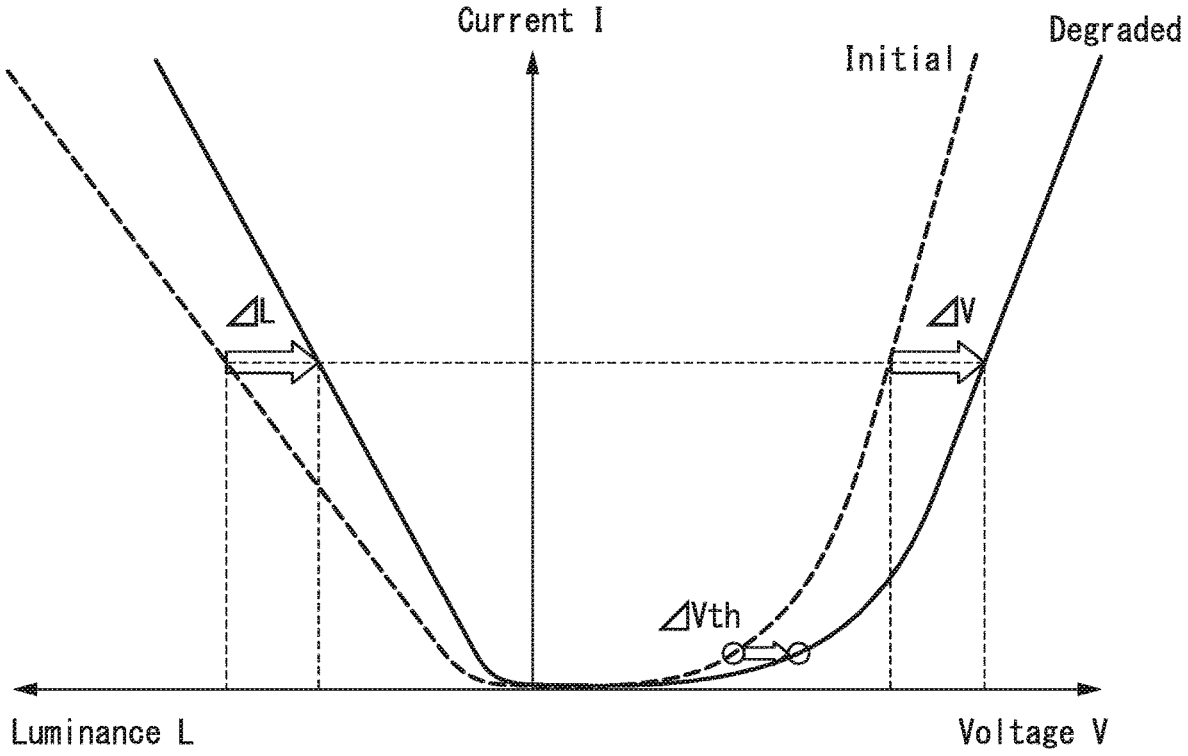
FIG. 6 is a graph showing a relationship between an electric current and luminance and a relationship between an electric current and voltage.

Here, FIG. 6 shows a relationship between the electric current ("I", vertical axis) and luminance ("L", left side horizontal axis) and a relationship between the electric current ("I") and a voltage ("V", right side vertical axis) of the OLED pixels at the time when delivering form a factory ("Initial", broken curve) and after aging degradation ("Degraded", curved line)

In FIG. 6, when an electric current is applied to an OLED, it can be understood that there are dV (delta V, a delta symbol is used in the drawings) indicating a voltage difference and a dL (delta L, a delta symbol is used in the drawings) indicating a luminance difference between the time when the product is delivered from the factory and the time after the age degradation. It is understood that these dV and dL are observed in the drawings widely across the electric current.

In addition, it can be understood that there is a point of the curve at which the OLED pixel starts increasing the electric current after outputting an electric current, that is, a point similar to an inflexion point, and it can be understood that there is a difference (dVth, delta Vth, a delta symbol is used in the drawings) between the time when the product is delivered from the factory and the time after the age degradation. It can be possible to use this inflexion point as an indicator for evaluating the degree of degradation of the OLED luminance.

This inflexion point may indicate the time when the OLED start outputting and increasing the electric current. When applying a voltage to the OLED, if the voltage is small, the OLED does not output the electric current. In accordance with voltage increase, the OLED may output the electric current. The voltage applied to the OLED when the OLED start outputting and increasing the electric current is not fixed or predetermined and can be fluctuate between OLED elements.

A signal indicating this inflexion point can be processed or handled in the same manner as a digital signal (trigger of ON/OFF). The electric current flow at the OLED can be a small value, for example, approximately a few nA, and thus, in order to directly measure the electric current output from the OLED, it requires an expensive linear amplifier, an environment without noise and long measurement time. However, in view of the inflexion point, if the signal indicating the inflexion point is amplified using a generally used amplifier, it can be possible to observe or detect the signal indicating the inflexion point while avoiding negative effect due to, for example, noises and parasitic capacitance. This is because it simply is detected whether or not there is the electric current output from the OLED, and it is not necessary to measure the electric current output from the OLED.

Figure 7:
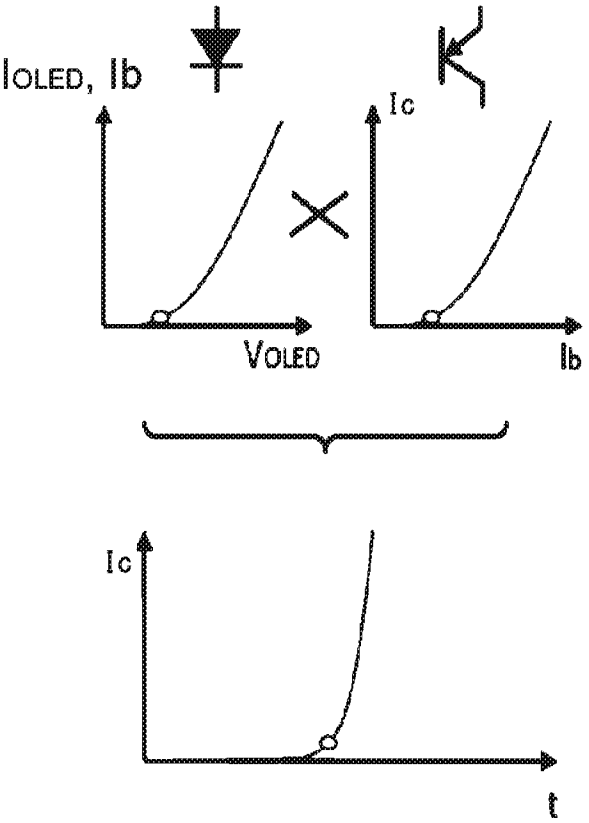
FIG. 7 shows three graphs in which an electric current output from an OLED is amplified by a transistor.

It is not necessary to use an amplifier with linear output characteristics because generally used amplifiers are appropriate for detecting whether or not there is the electric current output from the OLED. It is possible to apply a simple constitutional element, for example, a generally used transistor as the amplifier, and this may reduce the cost of the apparatus. FIG. 7 shows an amplifying operation of the OLED output current using a transistor.

In an upper left graph of FIG. 7, an horizontal axis indicates a voltage applied to the OLED, and a vertical axis indicates the electric current flow at the OLED. The voltage applied to the OLED becomes larger, and the output current through the OLED starts flowing.

An upper right graph of FIG. 7 shows a relationship between an electric current applied on a collector (Ic, vertical axis) and an electric current of a base (Ib, electric current applied to OLED, horizontal axis) of a generally used transistor. It is understood that when the electric current of the collector increases, the electric current of the base increases too.

A graph at the bottom of FIG. 7 shows the corrector current (Ic, vertical axis) according to the voltage increase applied to the OLED. A horizontal axis indicates time. The voltage applied to OLED is increased according to the time, and the output current of the OLED is generated and increased. Therefore, the corrector current increases.

Figure 8:
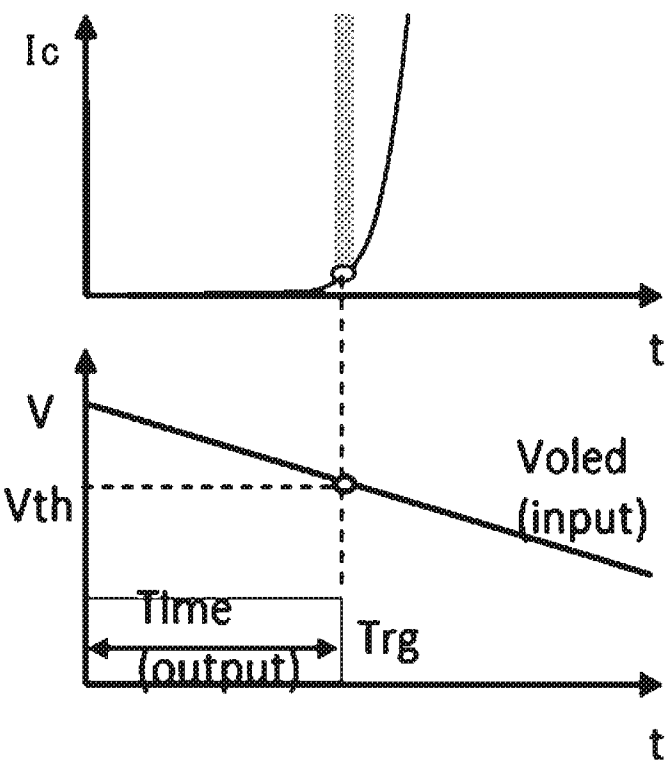
FIG. 8 shows a pair of graphs in which voltage applied to an OLED is reduced.

FIG. 8 is an example of observed output current of the OLED. An upper graph is the same graph as the bottom graph of FIG. 7 and shows the output current from the OLED which is amplified by a transistor. As shown in the bottom graph of FIG. 8, the voltage applied to the OLED (Voled) can be swept so as to be proportional to the time while monitoring the OLED output current, that is, a trigger signal. This sweeping operation can be conducted by reducing the voltage applied to a cathode of the OLED. During this operation, as shown in both upper and bottom graphs of FIG. 8, the trigger signal may appear at the same voltage as the inflexion point. In other words, in the bottom graph of FIG. 8, when the swept voltage increases, the voltage applied to the OLED becomes large, and the OLED starts outputting the current at the inflexion point. If the voltage sweep ratio is constant (ramp input, voltage is decreased according to time), an threshold voltage (Vth) at which the inflexion point is detected can be calculated based on the time when the trigger signal appears.

Figure 9:
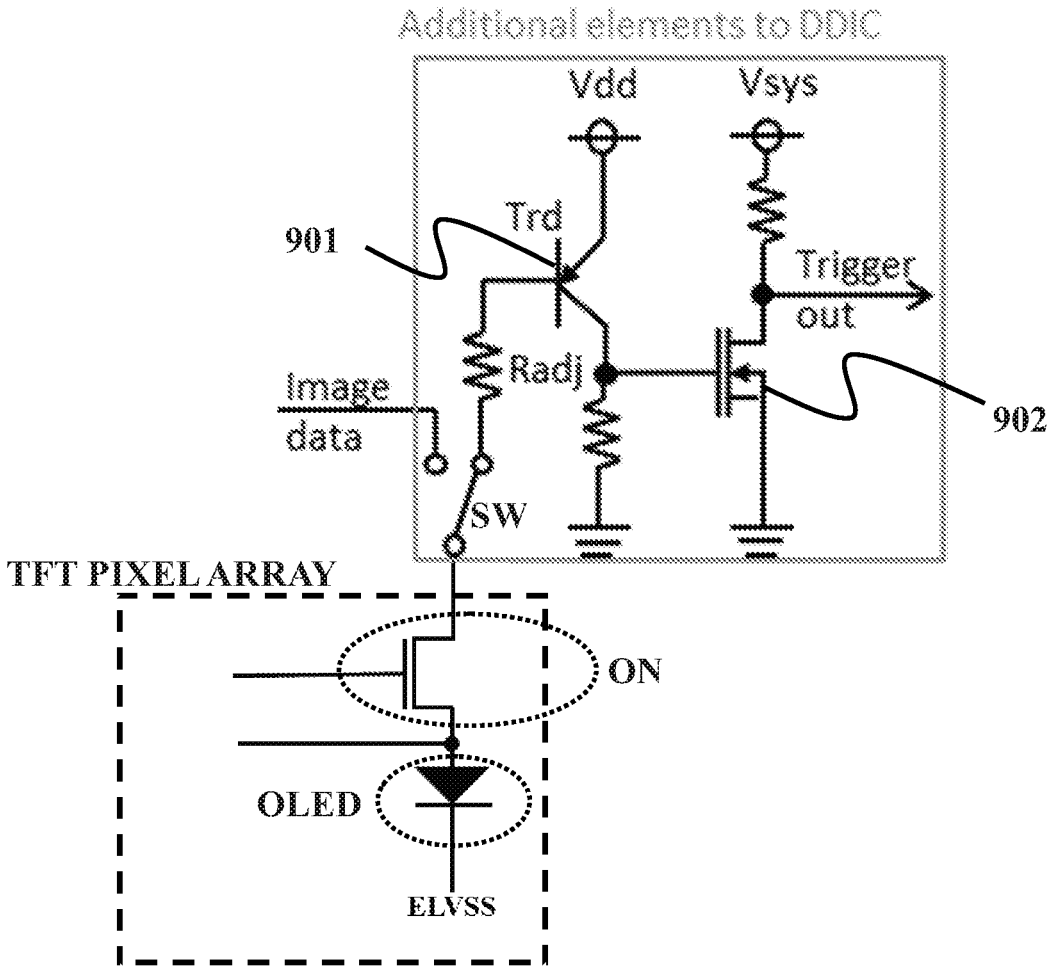
FIG. 9 is an overview of an additional element for amplifying a trigger signal.

Here, FIG. 9 is an example of an amplifier circuit (amplifier) converting an analog signal to a trigger signal. FIG. 9 includes one OLED. However, in concrete cases, multiple OLED elements can be arranged on a matrix including rows and columns. A transistor (Trd, 901) is added to a DDIC (display driver IC (integrated circuit)) and connected to a TFT (thin film transistor) pixel array. Radj (resistance) adjusts a driving voltage of the transistor. An electric current from a power source Vdd is supplied to an OLED pixel via an emitter-base of the transistor 901. All switches and/or TFT transistors are maintained to be "ON" so as to supply the driving current of the OLED pixel, and the current is applied to a common cathode ELVSS (low level power source) of OLED pixels.

A switch (SW) between the DDIC and TFT pixel array is set according to a selected data line in order to instruct image data supplied to the OLED pixel. In FIG. 9, the switch is connected to DDIC. When scanning the threshold voltage (Vth), the switch (SW) is connected to the transistor (Trd) 901. This is as shown in the drawing, the switch between the image data (Image data) and the DDIC is connected to the DDIC.

The electric current from the power source Vdd is supplied to the OLED pixel via the emitter-base of the transistor 901. An sweeping operation on the ELVSS gradually progresses, when the OLED pixel outputs the current, the transistor 902 is turned "ON" by the transistor 901, and a trigger signal (Trigger) is output. In other words, the transistor 902 is an amplifier which, when the electric current flows through the OLED pixel, generates an ON/OFF signal, that is, the trigger signal. The transistor 902 can be an inexpensive transistor.

Figure 10:
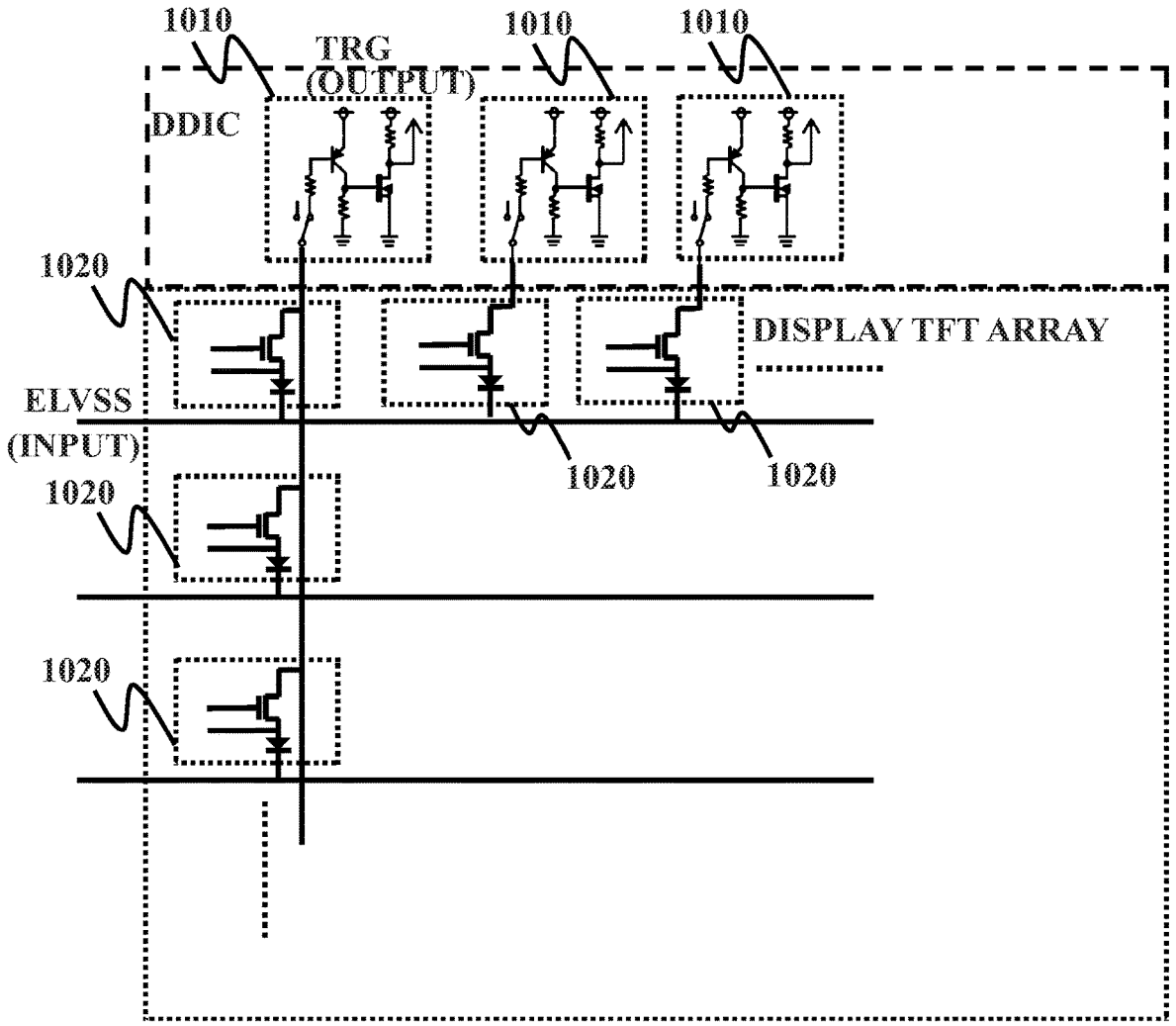
FIG. 10 is an overview of OLED pixel array with amplifier circuits.

As shown in FIG. 10, an amplifier (1010) of FIG. 9 is added to each of columns of OLED pixel (1020) array so as to be connected to the OLED pixels across the rows in a vertical direction. An electric current (Vdd of FIG. 9) is supplied to all OLED pixels (1020) of each column from the DDIC. Each of the rows of a display TFT array is selected in a serial manner, the transistor of the OLED pixel (1020) is turned "ON", and the electric current is applied to the OLED of the selected row. The row under the scanning operation is changed or switched in a serial manner. Therefore, all rows can be scanned. Regarding each of the rows, this scanning operation is conducted on all columns, and all pixels on the screen can be scanned within, for example, approximately 6 seconds. The time for scanning one row can be, for example, approximately 6/1920 (seconds). The time for conducting this scanning operation may be dependent on, for example, a number of OLED pixels and/or hardware constituting the system. This scanning operation can be conducted, for example, after receiving a power-off instruction form a user of a device such as a cellular phone.

The amplifier of FIG. 9 can be arranged at each of the rows. It may be possible to change the rows to columns of this embodiment.

Figure 11:
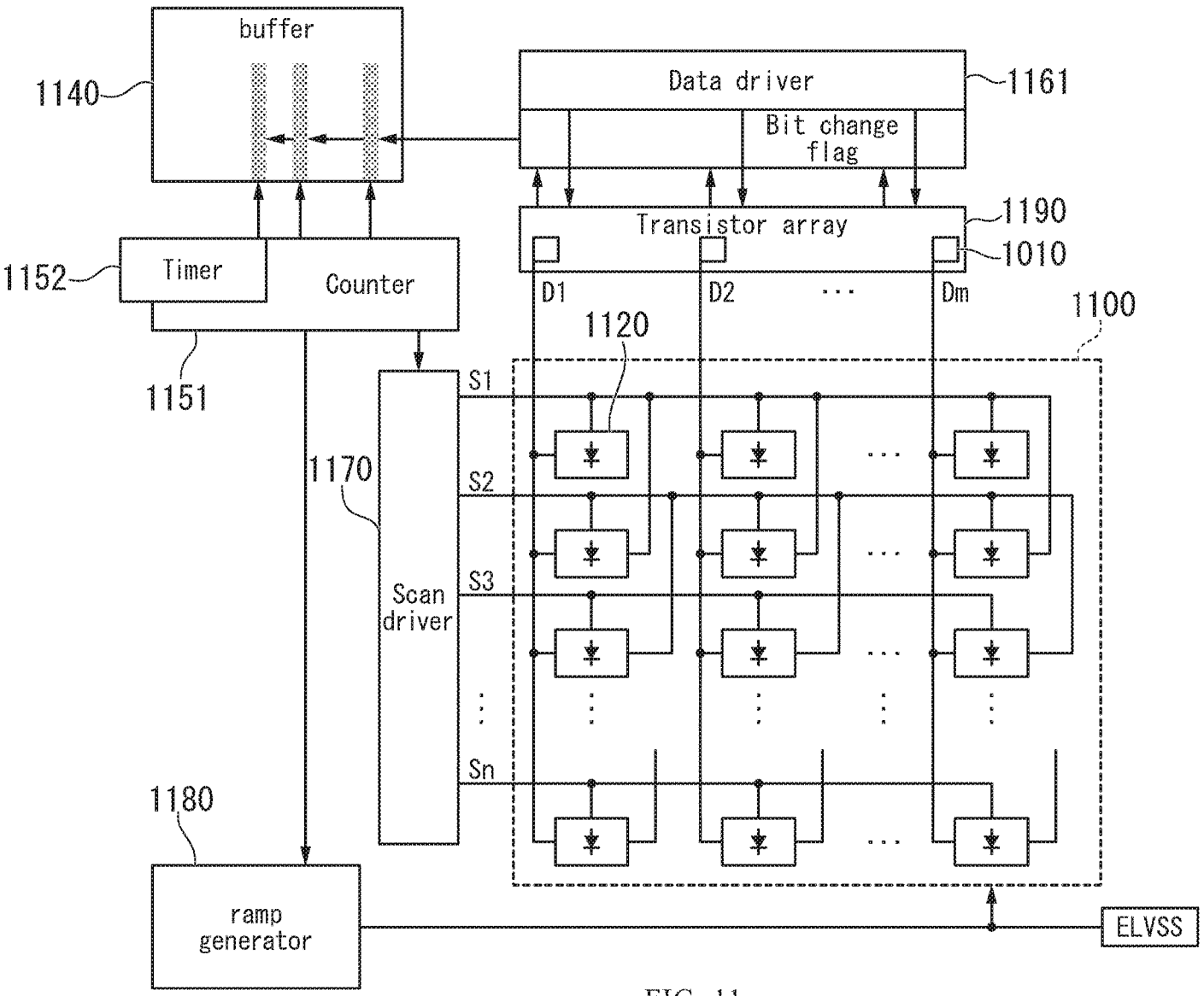
FIG. 11 is an overview of an image display apparatus.

FIG. 11 is an example of an image processing apparatus of this embodiment.

An OLED array 1100 includes OLED pixels 1120 (1020 of FIG. 10) arranged at and connected to crossing portions of scanning lines S1 to Sn and data lines D1 to Dm (m and n are natural numbers). The OLED pixels 1120 are arranged on a predetermined number of columns and a predetermined number of rows. The number of columns is, for example, 1080, and the number of rows is, for example, 1920. The numbers of rows and columns can be larger and/or smaller than these numbers.

The OLED pixels 1120 are connected to a first power source (for example, the power source Vdd shown in FIG. 9) and a second power source (ELVSS). The amount of the electric current supplied from the first power source to ELVSS via the OLED pixel 1120 is controlled based on the data signal. At the OLED pixel 1120, the light with luminance according to the data signal is generated.

A scan driver 1170 outputs scanning signals on the scanning lines S1 to Sn in accordance with counter signals from a timer 1152/counter 1151.

A data driver 1161 outputs data signals on the data lines D1 to Dm in accordance with counter signals from the timer 1152/counter 1151.

The data driver 1161 can select all columns. The scan driver 1170 selects one of the rows and can drive all OLED pixels 1120 of the selected row. The scan driver 1170 can select each row of the OLED array 1100 in a serial manner. As a result, all rows can be selected in a serial manner, and all pixels can be driven. The scan driver 1170 can be a control circuit or a processor.

A ramp generator 1180 is commonly connected to cathodes of all OLED pixels 1120. The ramp generator 1180 inputs/receives the counter signals from the counter 1151/timer 1152 and outputs ramp signals to each OLED pixel 1120 of the OLED array 1100 in reference to the counter signals. In other words, the timer 1152/counter 1151 and the ramp generator 1180 conducts operations according to the same clock signals. A buffer 1140 inputs/receives the counter signals from the counter 1151/timer 1152 too. ELVSS is connected to the cathodes of the OLED array 1100.

The electric current from the transistor array 1190 (arranged on DDIC of FIG. 10) is applied to each OLED pixel 1120 of the OLED array 1100 (D1 to Dm). When using a device, for example, a cellular phone, including this OLED allay 1100 in a general condition, lines of D1 to Dm can be used as data lines of images.

It is possible to reduce the voltage of ELVSS in accordance with the signals from the ramp generator 1180.

At a time when the OLED trigger signal is generated, an OLED threshold voltage (Vth) can be the same voltage as that of ELVSS. When the trigger signal is generated from the transistor 902 while sweeping ELVSS as described in FIG. 8, a bit change monitor 1162 inputs/detects this trigger signal. The bit change monitor 1162 included in the data driver 1161 outputs both one of column numbers of lines D1 to Dm corresponding to the OLED pixel which output the trigger signal and a flag indicating generation of the trigger signal to the buffer 1140. The buffer 1140 can be a circuit/processor including a nonvolatile memory.

In addition, the buffer 1140 inputs/receives the counter signals from the counter 1151/timer 1152. When the trigger signal is generated, the buffer 1140 obtains a counter value indicating a timer clock at the time when inputting/receiving the trigger signal from the counter signal and stores the counter value in the nonvolatile memory of the buffer 1140. The time passed after starting the scanning operation corresponds to the counter value or, for example, can be obtained by multiplying a predetermined value and the counter value. It is possible to obtain the time between commencement of the scanning operation to generation of the trigger signal/inflexion point described in FIG. 8.

ELVSS and the ramp generator 1180 are synchronized with the clock signals generated by the counter 1151/timer 1152 too. Therefore, the counter value stored in the buffer 1140 indicates the time until generation of the trigger signal/inflexion point (time stamp). In addition, the counter value, that is, the time stamp means the OLED threshold voltage (Vth) because the voltage sweep ratio is constant. The amount of reduced voltage can be calculated by multiplying the voltage sweep ration and the time until the inflexion point generation, and thus, it is possible to obtain the OLED threshold voltage (Vth) too.

Each column has a common electric power rail of ELVSS (FIG. 11). Therefore, it is possible to simultaneously inspect or scan all OLED pixels of each of the OLED pixel arrays. In addition, the row of the OLED pixel array under scanning or inspecting operation is changed or switched in a serial manner, and thus, it is possible to quickly scan overall pixels. For example, it may be possible to scan all rows of OLED pixels within six seconds. Regarding a full HD (high definition) screen, it may take 6/1920 second for scanning one row of the pixels. Within this time, the voltage sweep operation on one row shown in FIG. 8 is conducted.

Figure 12:
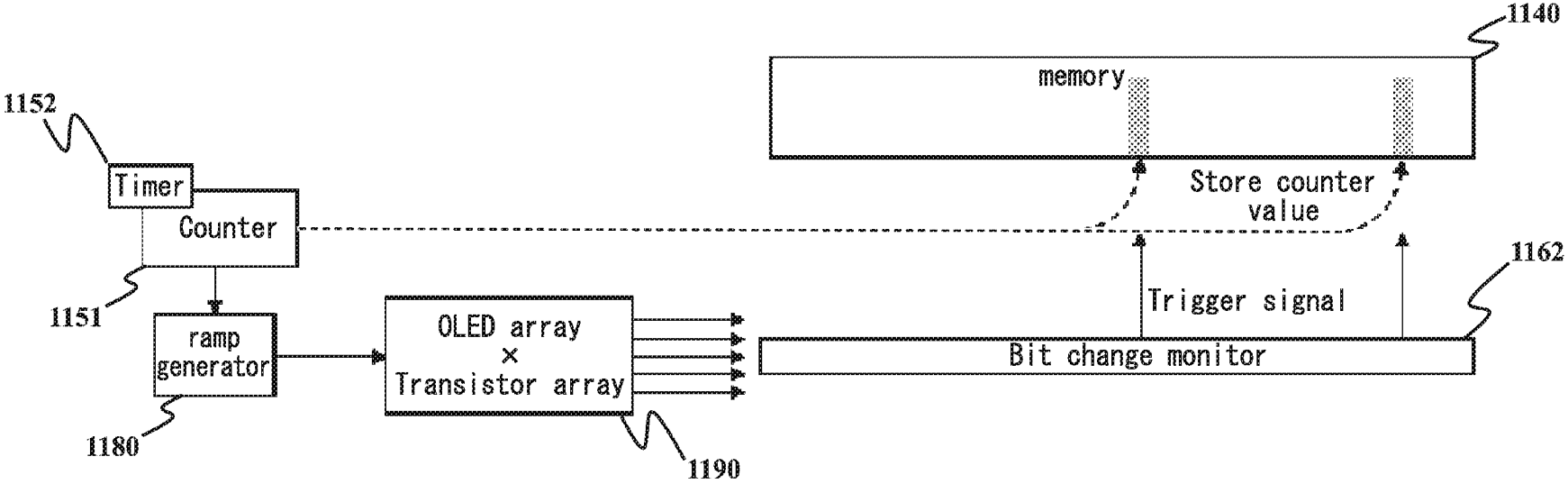
FIG. 12 is an overview of a system for detecting trigger signals from pixels.

FIG. 12 shows a portion of constitutional elements of FIG. 11. When the trigger signal is generated after an electric current is output from the OLED pixel, a buffer (memory) 1140 stores a counter (1151) value/timer clock (1152) corresponding to each trigger signal. A ramp generator 1180 of ELVSS conducts operations while synchronizing the clock of the counter 1151/timer 1152. As shown in a left graph of FIG. 13, voltage applied to an OLED (Voled) is swept proportionally to the counter 1151/timer 1152, and a trigger signal is generated at the OLED threshold voltage (Vth).

Therefore, the timestamp means the OLED threshold voltage (Vth). If the buffer (1140) stores the timestamp or the counter value, the buffer may substantially record the OLED threshold voltage (Vth). Therefore, it is possible to simultaneously detect the OLED threshold voltage (Vth) of all OLED pixels on each row (selected for inspecting or scanning) of the OLED pixel array because the ELVSS electric power rail is commonly shared by the pixels of each column (FIG. 10). In addition, all rows are scanned in a serial manner, and thus, it is possible to quickly scan all pixels.

Figure 13:
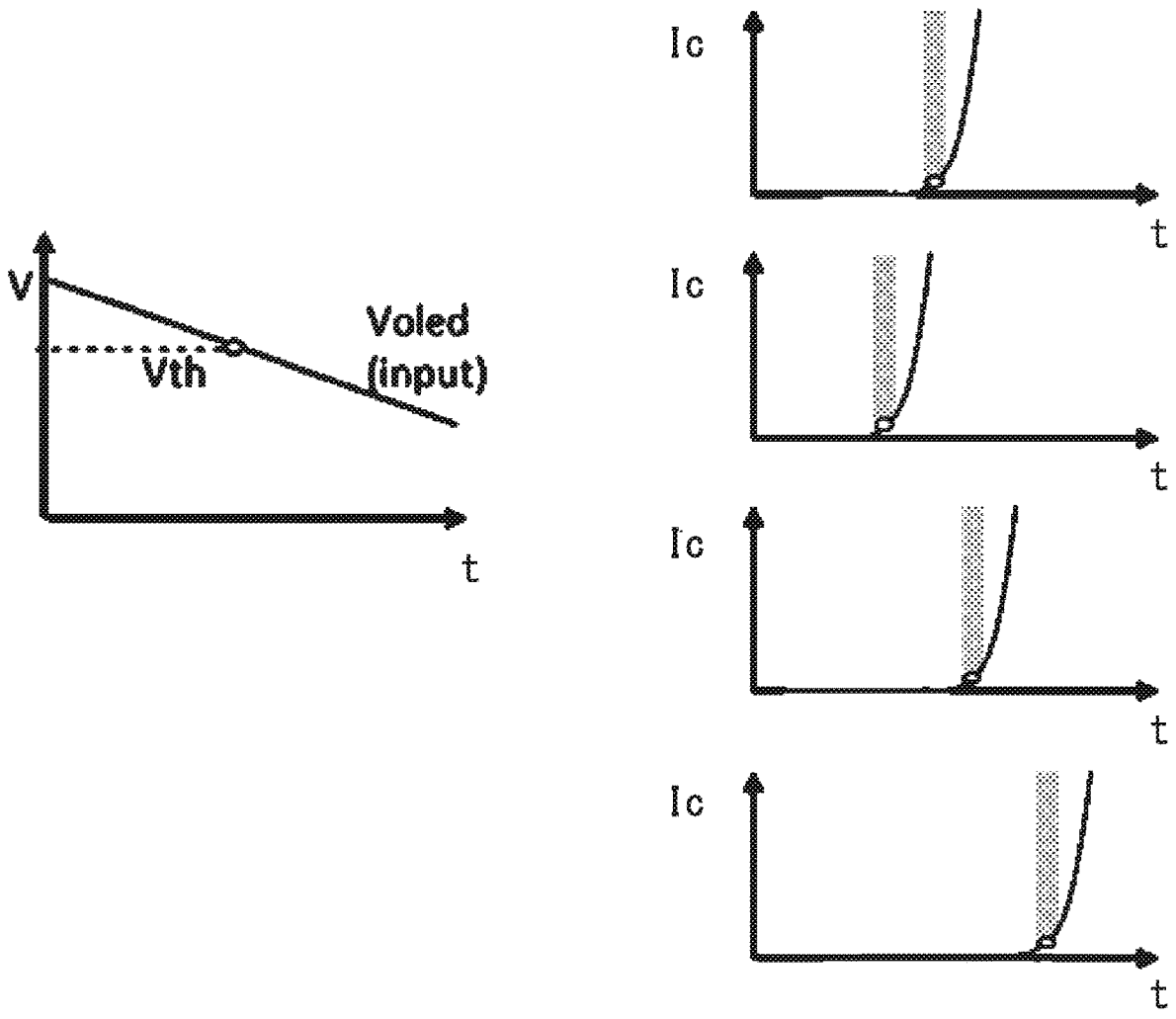
FIG. 13 shows four graphs indicating trigger signals from pixels.

The OLED threshold voltage can be different between the OLED pixels as shown in four graphs at the right side of FIG. 13. In reference to FIG. 14, it is understood that the counter value corresponding to the output time of the trigger signal can be different between the OLED pixels. Identifiers H0 to 1440 indicates OLED pixels on one row. The counter is increased from T0 to T255 according to time increase. On proportional to increase of the counter, as shown in the left graph of FIG. 13, the voltage applied to the OLED pixel is swept. The OLED pixel may output the electric current due to the seeping operation on the voltage.

Figure 14:
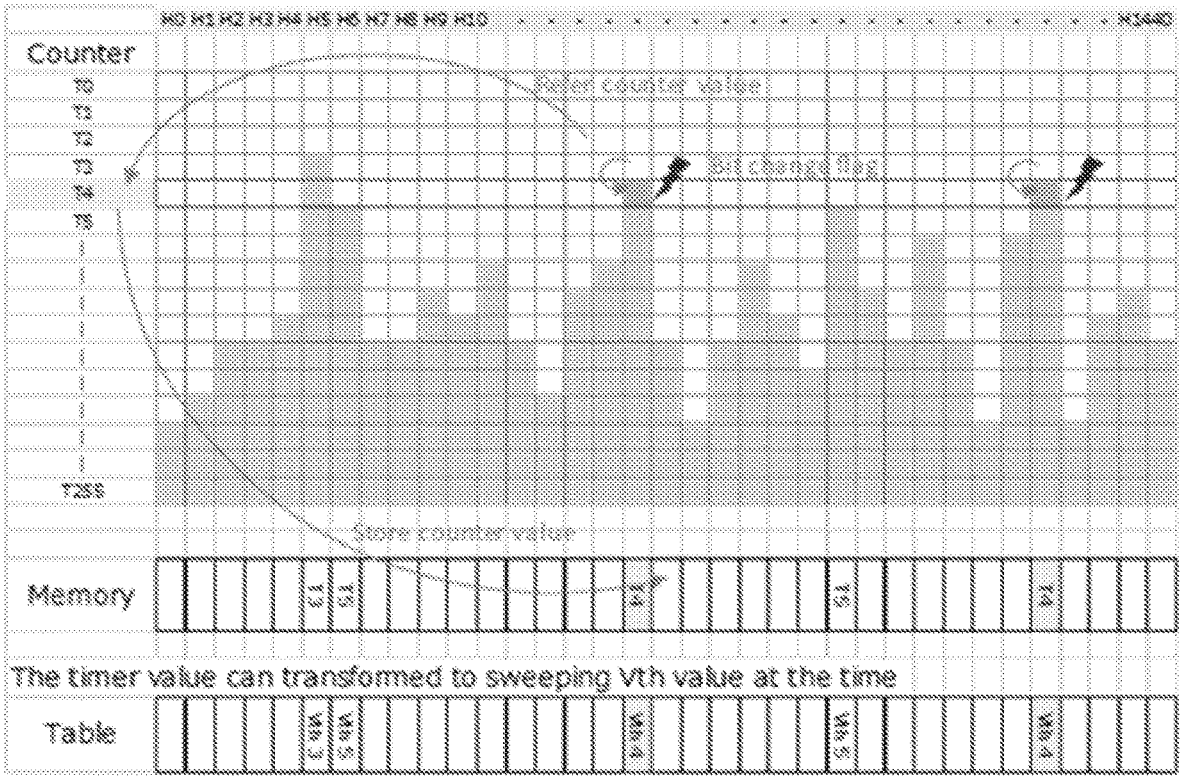
FIG. 14 shows a graph of counter values of trigger signals.

In the circuit of FIG. 9, when the OLED pixel outputs the electric current, the transistor 902 is turned "ON", and the trigger signal (Trigger) is output from the circuit. In FIG. 14, it is detected that an OLED pixel at a center of the drawing output the electric current (trigger signal (Trigger) is generated) at the time when the counter value is T4. A data driver 1161/bit change monitor 1162 receives the trigger signal from a transistor array 1162 and detects generation of the trigger signal. The data driver 1161/bit change monitor 1162 outputs the column number, for example, "H100" (and a row number, for example, "500"). A buffer 1140 receives and stores the column number (row number) and a timestamp/counter.

Furthermore, the OLED threshold voltage can be different between the time when the product is delivered from the factory and the time after the age degradation. The OLED threshold voltage can be larger due to the age degradation. For example, between four graphs at the right side, a fourth graph in which the OLED threshold voltage is detected at the latest time may indicate a possibility that the luminance of the OLED pixel is deteriorated compared to the time when the product is delivered from the factory. In addition, for example, if a trigger signal is not detected, there is a possibility that the OLED pixel is broken. In this case, there is possibility that the diode of the OLED pixel is broken, and/or there is a possibility that other peripheral elements such as a transistor is broken.

Hereafter, evaluation methods of degradation degree of OLED pixels in this embodiment are explained.

Figure 15:
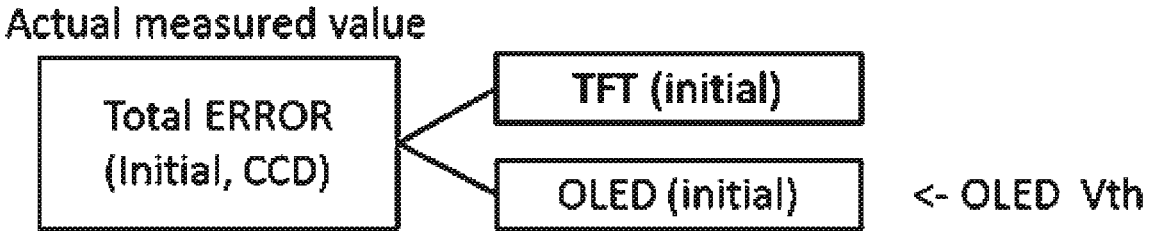
FIG. 15 is an overview showing a relationship between initial TFT error and initial OLED error.
Figure 16:
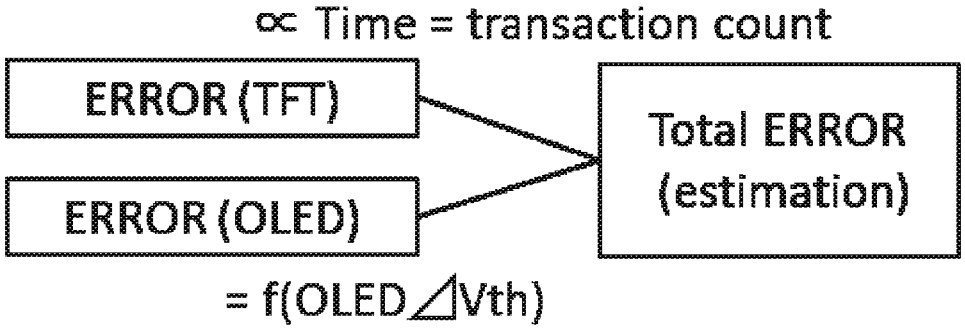
FIG. 16 is an overview showing a relationship between TFT error and OLED error.

There may be several approaches to evaluate the degradation degree of each OLED pixel based on values of OLED threshold voltage (Vth). In FIGS. 15 and 16, "L" is luminance of an OLED pixel. dL (delta L, a delta symbol is used in the drawings) indicates a luminance change/difference. dVth (delta Vth, a delta symbol is used in the drawings) indicates a change/difference of an OLED voltage threshold (Vth). The simplest solution may be a method in which a simple predetermined calculation model between dL and dVth is provided beforehand. For example, a proportional relationship can be assumed between dL and dVth.

However, a calculation model can be more complex in a practical use. The degradation degree may be different between the OLED materials (R/G/B, red, green and blue). In addition, in general, the degradation degree can be different between the pixels constituted from the same material due to, for example, differences of vapor deposition conditions. Furthermore, dL can be caused by not only OLED errors, but also TFT errors.

There may be another solution in which a difference of the timer/counter stored in the buffer 1140 between the time when the product is delivered from the factory and the time after age degradation is used as dVth in place to the change/difference of the OLED voltage threshold (Vth).

FIG. 15 shows an outline of a method for calculating an initial error at the time when the product is delivered from the factory. An initial error of an OLED pixel may include both an initial error of the OLED (diode) itself and an initial error of, for example, a TFT. As shown in FIG. 3, this initial error of an OLED pixel can be compensated using external devices, for example, a CCD.

Regarding a difference between the initial error of the OLED pixel including TFT error and the error of the OLED (diode) itself, a value of the OLED threshold voltage (Vth) can be indirectly used for evaluating an initial TFT error.

In general, TFT errors can follow a calculation model based on time with a great extent. Therefore, in accordance with the hours of operation of a device, a possibility of TFT errors may become larger. This TFT error model may be more stable and simple compared to a calculation model of OLED errors.

It may be possible to calculate total amount of radiation time of the pixels. For example, in FIG. 11, it may be possible for the data driver 1161 to measure the radiation time of the pixels and store/update the measured radiation time in the buffer 1140. Initial parameters can be obtained by the above-described operation, and thus, it may be possible to evaluate the degradation degree using an age degradation model including a combination of TFT and OLED. It may be possible to use the OLED threshold voltage (Vth) not for TFT error estimation but for OLED degradation estimation, whose degradation is not dependent on a calculation model simply affected by only time or aging.

For example, in FIG. 15, it is assumed that the OLED threshold voltage (Vth) at the time when the product is delivered from the factory includes both initial values of initial values of TFT error and OLED error. In addition, in FIG. 16, it is assumed that a TFT error after age degradation can be proportional to the radiation time of each pixel. The OLED threshold voltage (Vth) may be affected by the initial values of both TFT errors and OLED errors.

It is assumed that a negative impact on dVth from the age degradation due to TFT errors can be proportional to hours of operation. Here, it can be understood that dVth corresponds to the value of the timer/counter shown in FIG. 13 when the trigger signal is generated. It is possible to calculate the amount of negative impact on dVth caused by the age degradation due to TFT errors in accordance with a calculation of multiplying the initial value of OLED threshold voltage (Vth) at the time when the product is delivered from the factory, a total amount of radiation time and a proportionality constant.

For example, if it is assumed that the initial value of TFT error is approximately 10% compared to the initial value of OLED error, and if it is assumed that 10,000 hours operation of the device causes TFT errors which is 3% of the initial value of TFT errors, it is possible to estimate the negative impact caused by the TFT errors using a formula of "dVth×0.1×(operation time/10,000)×0.03". It may be possible to estimate the OLED error due to the age deterioration by calculating a difference based on this estimated TFT error.

The above formula and explanation are mere example. It may be possible to use the values of OLED threshold voltage (Vth) as an supplemental parameter for further estimating errors due to deterioration.

The above-described estimation operation can be conducted using, for example, a processor in reference to the buffer 1140. This processor can be a processor of, for example, a mobile device. This processor can be the data driver 1161. It may be possible for the data driver 1161 to store the total operation time of the pixel elements in the buffer 1140. Here, it is possible to calculate dVth as a difference of the counter/timer stored in the buffer 1140 between the current Vth and the initial values measured at the time when the product was delivered from the factory. It may be possible for the data driver 1161 to multiply dVth and a weighting factor and add the weighted dVth to the total operation time. For example, if the total operation time of a pixel is 5,000 hours, and if dVth is 0.01 milliseconds, a calculation of 5,000+0.01×10,000 (weighting factor) can be conducted to evaluate the deterioration. If this calculation result is larger than the actual total operation time, for example, 30% larger, it may be possible to determine that the pixel is deteriorated.

It may be possible for the data driver 1161 to increase the voltage applied to the pixel elements when displaying an image if the total operation time of the pixel element is long. For example, if the total operation time is 1,000 hours, the data driver 1161 can increase the voltage by 1,000×0.001 (%), where "0.001" is a predetermined factor. The total operation time of the pixel element can be modified using dVth, for example, adding dVth×10,000 to the total operation time.

In addition, for example, in the left graph of FIG. 13, if the data driver 1161 detects a pixel which does not raise a trigger signal within a predetermined time interval (for example, 6 milliseconds), the data driver 1161 can determine that the pixel is broken, store an error record on the buffer 1140 and decide to suspend applying the electric current anymore.

In accordance with the above-described embodiment(s), it may be possible to obtain/inspect a key value(s) to estimate the age degradation degree for each pixel in feasible cost even after delivering the product form the factory. In addition, the embodiment may compensate the image burn-in and improve image uniformity of the OLED display.

The above-described embodiment can be applied to a cellular phone. The above-described embodiment can be applied to a mobile device, for example, a personal computer. In addition, the above-described embodiment can be applied to, for example, a car navigation system, television set, outdoor advertisement, display devices used indoor (for example, trains, aircrafts and/or elevator) and/or medical devices.

What is claimed is:

1. An image display apparatus comprising:

a plurality of pixel elements configured to display an image;

a first power source coupled to the pixel elements and configured to apply a first voltage to the pixel elements;

a counter configured to output counter signals;

a ramp generator coupled to the counter and configured to:

receive the counter signals; and output ramp signals according to the counter signals;

a second power source coupled to the ramp generator and the pixel elements and configured to apply a second voltage to the pixel elements according to the ramp signals;

an amplifier coupled to the pixel elements and configured to output a trigger signal when a first pixel element of the pixel elements outputs a first electric current;

a data driver coupled to the ramp generator and the counter and configured to output a counter value according to a counter signal and the trigger signal; and a buffer coupled to the data driver and configured to store the counter value.

2. The image display apparatus of claim 1, wherein the second power source is further configured to sweep the second voltage according to the ramp signals.

3. The image display apparatus of claim 1, wherein the pixel elements are arranged on a matrix, wherein the matrix comprises a predetermined number of rows and a predetermined number of columns, wherein the data driver is further configured to output the counter value with a column number on which the first pixel element is arranged, and wherein the buffer is further configured to store the counter value with the column number.

4. The image display apparatus of claim 3, wherein the amplifier is further configured to correspond to each of the columns of the pixel elements.

5. The image display apparatus of claim 4, further comprising a control device coupled to the pixel elements and configured to select a first row of the matrix, wherein the first power source is further configured to apply a third voltage to pixel elements on the first row, and wherein the second power source is further configured to apply a fourth voltage to the pixel elements on the first row.

6. The image display apparatus of claim 5, wherein the control device is further configured to repeatedly select the rows of the matrix in a serial manner, and wherein the data driver is further configured to store the counter value and column numbers of pixel elements of each of the rows in the buffer.

7. The image display apparatus of claim 1, wherein the pixel elements are arranged on a matrix, wherein the matrix comprises a predetermined number of rows and a predetermined number of columns, and wherein the amplifier is further configured to correspond to each of the rows.

8. The image display apparatus of claim 1, wherein the amplifier comprises an emitter and a base, wherein the emitter is configured to receive a second electric current from the first power source, wherein the base is configured to output the second electric current, and wherein the first pixel element is configured to receive the second electric current that is output from the base.

9. The image display apparatus of claim 1, further comprising a processor coupled to the pixel elements and configured to detect errors of the pixel elements according to the counter value.

10. The image display apparatus of claim 1, further comprising a processor coupled to the pixel elements and configured to:

identify that the trigger signal is not output within a predetermined time interval; and detect an error of one of the pixel elements based on identifying that the trigger signal is not output within the predetermined time interval.

11. A controlling method of an image display apparatus, the controlling method comprising:

applying, by a first power source, a first voltage to a plurality of pixel elements;

outputting, by a counter, counter signals to a ramp generator;

generating, by the ramp generator, ramp signals based on the counter signals;

applying, by a second power source and to the pixel elements, a second voltage according to the ramp signals;

outputting, by an amplifier, a trigger signal when a first pixel element of the pixel elements outputs a first electric current;

outputting, by a data driver, a counter value according to a counter signal and the trigger signal;

receiving, by a buffer, the counter value from the data driver; and storing, by the buffer, the counter value.

12. The controlling method of claim 11, further comprising sweeping, by the second power source, the second voltage according to the ramp signals.

13. The controlling method of claim 11, wherein the pixel elements are arranged on a matrix, wherein the matrix comprises a predetermined number of rows and a predetermined number of columns, and wherein the controlling method further comprises:

outputting, by the data driver, the counter value with a column number on which the first pixel element is arranged; and storing, by the buffer, the counter value with the column number.

14. The controlling method of claim 13, wherein the amplifier corresponds to each of the columns.

15. The controlling method of claim 14, further comprising:

selecting, by a control device, a first row of the matrix;

applying, by the first power source, a third voltage to pixel elements on the first row; and applying, by the second power source, a fourth voltage to the pixel elements on the first row.

16. The controlling method of claim 15, further comprising:

repeatedly selecting, by the control device, the rows of the matrix in a serial manner; and storing, by the data driver, the counter value and column numbers of pixel elements of each of the rows in the buffer.

17. The controlling method of claim 11, wherein the pixel elements are arranged on a matrix, wherein the matrix comprises a predetermined number of rows and a predetermined number of columns, and wherein the amplifier corresponds to each of the rows.

18. The controlling method of claim 11, further comprising:

receiving, by an emitter of the amplifier, a second electric current from the first power source;

outputting, by a base of the amplifier, the second electric current; and receiving, by the first pixel element, the second electric current that is output by the base.

19. The controlling method of claim 11, further comprising detecting, by a processor, errors of the pixel elements according to the counter value.

20. The controlling method of claim 11, further comprising:

identifying, by a processor, that the trigger signal is not output within a predetermined time interval; and detecting, by the processor, an error of one of the pixel elements based on the processor identifying that the trigger signal is not output within the predetermined time interval.

* * * * *